US006374851B1

(12) United States Patent
Coventry

(10) Patent No.: US 6,374,851 B1
(45) Date of Patent: Apr. 23, 2002

(54) CONTAINER FOR A COMPRESSED FLUID

(75) Inventor: Andrew Coventry, Queensland (AU)

(73) Assignee: Emerald Enterprises PTY LTD (AU)

( * ) Notice: Subject to any disclaimer, the term of this patent is extended or adjusted under 35 U.S.C. 154(b) by 0 days.

(21) Appl. No.: 09/555,572

(22) PCT Filed: Dec. 1, 1998

(86) PCT No.: PCT/AU98/01001

§ 371 Date: Jun. 1, 2000

§ 102(e) Date: Jun. 1, 2000

(87) PCT Pub. No.: WO99/28669

PCT Pub. Date: Jun. 10, 1999

(30) Foreign Application Priority Data

Dec. 1, 1997 (AU) ..... PP 0663

(51) Int. Cl.[7] ..... F16L 7/00

(52) U.S. Cl. ..... 137/375; 137/587; 137/592

(58) Field of Search ..... 137/375, 587, 137/592; 220/581, DIG. 7; 165/163, 156; 62/45.1

(56) References Cited

U.S. PATENT DOCUMENTS 751,776 A * 2/1904 Bieger ..... 137/375
753,450 A * 3/1904 Thuemling ..... 137/375
1,699,613 A * 1/1929 Ebinger ..... 137/375
2,056,800 A * 10/1936 Mohn ..... 137/587
2,148,109 A * 2/1939 Dana et al. ..... 62/45.1
3,482,625 A * 12/1969 Bray ..... 165/108
4,404,819 A * 9/1983 Leonard ..... 62/51.1
5,765,385 A * 6/1998 Childs ..... 165/163

FOREIGN PATENT DOCUMENTS

GB 1202241 6/1967

* cited by examiner

*Primary Examiner*—A. Michael Chambers

(57) ABSTRACT

A container (10) for holding a supply of compressed fluid such as carbon dioxide has a length of tube (12) formed into a multi turn helical coil (14). A first valve (16) is provided at the lowest end (18) of the coil (14) for controlling the flow of fluid out of the container (10). A thermal insulating setable foam (20) envelopes the tube (12) and coil (14), though not the valve (16) which is disposed outside of the foam (20). A strap (26) extends about the coil (14) to bind the turns of the coil (14) together for added safety and strength. Coil (14), and setable foam (20) are disposed within a heat insulating housing (28). Inlet valve (22) is attached to an upper end of the tube (12) proximate the highest one of the turns of the coil (14).

20 Claims, 1 Drawing Sheet

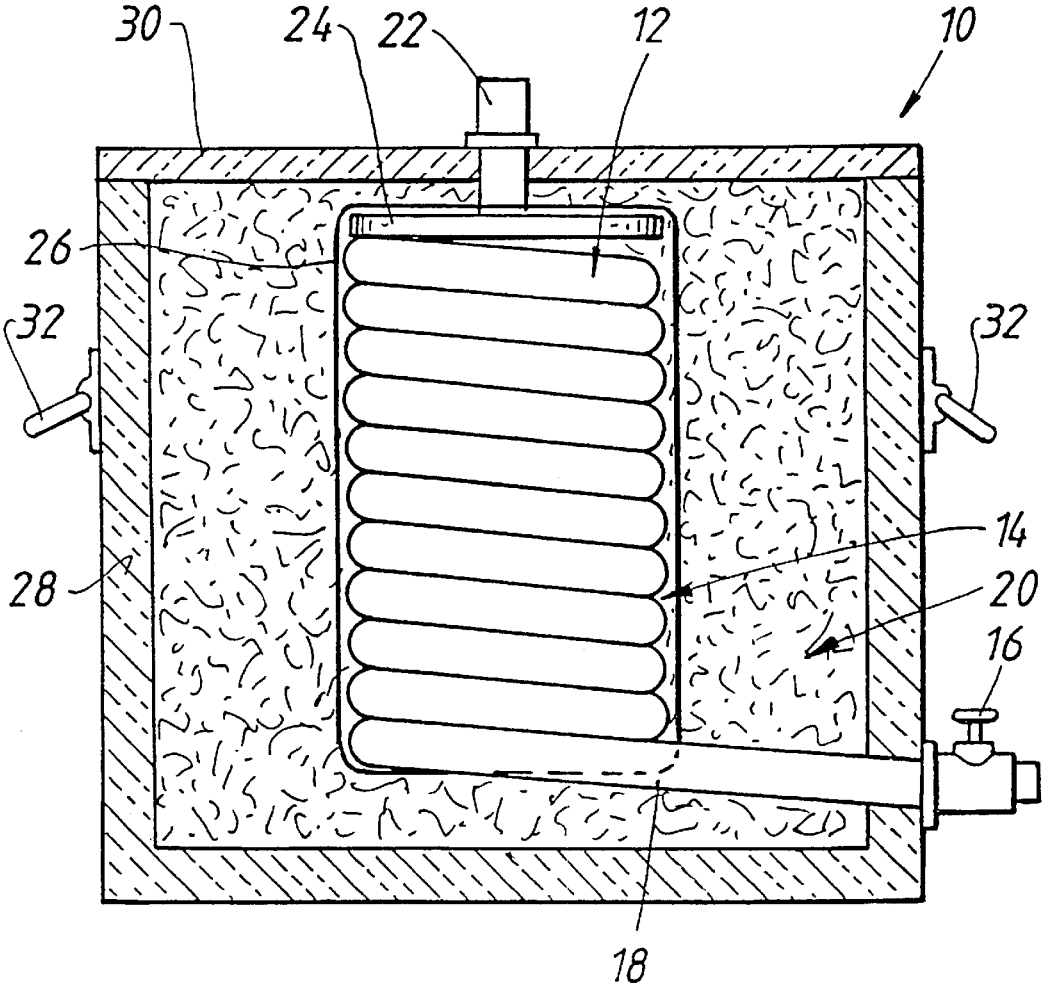
30
24
22
12
10
26
32
32
14
28
20
16
18

CONTAINER FOR A COMPRESSED FLUID

FIELD OF THE INVENTION

The present invention relates to a container for a compressed fluid and in particular, although not exclusively, to a container for a compressed refrigerant such as carbon dioxide or nitrogen.

BACKGROUND OF THE INVENTION

It is known to store compressed fluid and in particular gas in metallic vessels such as cylinders and tans. The volume of compressed gas stored within the vessel is governed by the well known equation Volume=Pressure/Temperature. Therefore, the volume of stored gas can be increased by either increasing gas pressure or decreasing gas temperature. In order to withstand high pressures the vessels have thick metallic walls. Further, the vessels are also often insulated to reduce the gas temperature and thereby maximise the storage volume. As a result the vessels are often very large and very heavy, and therefore particularly unsuited to applications were only small volumes of compressed gas may be required.

Also, these known vessels are typically in the form of closed or sealed cylinders. The cylinders define an internal space for holding the compressed gas. As a compressed gas is used, the gas pressure within the vessel decreases. Often, the most useful form of the compressed gas is when it is compressed to an extent that it is in the form of a liquid, for example liquid carbon dioxide or liquid nitrogen. The compressed gas can be held in a liquid form provided the pressure and temperature conditions within the vessel are maintained at predetermined levels. However, a problem with the current relatively large volume vessels is that gas pressure within the vessel decreases quickly as the liquid within the vessel is depleted. The decrease in pressure causes the boiling of the liquid which is a substantial drawback when the liquid is being used as a refrigerant.

SUMMARY OF THE INVENTION

The present invention was developed with a view to providing a relatively small volume container for holding a compressed gas in which one or more of the above described deficiencies may be reduced According to the present invention there is provided a container for a compressed fluid, the container including:

length of tube formed into a coil and provided at one end with a first valve for controlling flow of the fluid out of the container, said coil being in the form of a helix having a first set of turns that are disposed about a vertical axis, and wherein said first valve is disposed at a height or level no greater than that of the lowest of the turns; and, heat insulating means enveloping said tube Preferably the helix includes a second set of turns disposed within the first set of turns.

Preferably the container includes a pressure relief valve at an opposite end of the tube and wherein the opposite end is proximate a highest one of the turns, Preferably the heat insulating means comprises a setable thermally insulating foam.

In an alternate embodiment, the heat insulating means comprises an evacuated sleeve coaxially formed with and about an outer surface of the tube.

Preferably the container includes one or more straps for binding the turns of the coil together.

Preferably, the container further includes an exterior thermally insulating housing which houses the tube and the heating insulating means.

BRIEF DESCRIPTION OF THE DRAWINGS

An embodiment of the present invention will now be described by way of example only with reference to the accompanying drawing FIG. 1 which depicts a sectional view of one form of the present container

DETAILED DESCRIPTION OF THE PREFERRED EMBODIMENTS

A container 10 for holding a supply of a compressed fluid such as a carbon dioxide or nitrogen includes a length of tube 12 which is formed into a coil 14 and has a first valve 16 in fluid communication with one end 18 of the coil 14 for controlling the flow of fluid out of the container 10. Heat insulating means in the form of a setable foam 20 envelopes the tube 12 and coil 14 though not the valve 16 which is disposed outside of the foam 20.

The coil 14 is in the form of a helix having a first set of turns which are disposed about a vertical axis (not shown). The first end 18 of the coil 14 is proximate the lowest one of the turns in the coil 14. Moreover, the valve 16 is advantageously disposed at a height or level no greater than that of the lowest turn of coil 14. In this way any liquid within the tube 12 will be presented to the valve 16 by the action of gravity. This ensures that the liquid form of the fluid in tube 12 is passed to any system to which the container 10 is connected. Clearly the liquid form of the fluid has greater thermal capacity than the gas form. Valve 16 is also used to bleed off any air in the tube 12 prior to filling.

An inlet valve 22 is attached to the other end of the tube 12 and is proximate the highest of the turns in the coil 14. Sections with the tube 12 to which the valve 22 is connected pass through an upper plate 24 which is held onto the top of the coil 14 by a strap 26 which extends about the coil 14. The strap 26 assists in binding the turns of coil 14 together for added safety and strength. The inlet valve 22 is a standard valve used for filling the tube 12 and has an integrated pressure relief valve as a part thereof.

When constructing the container 10, the coil 14 including plate 24 and strap 26 are dropped into a thermally insulating housing 28. The foam 20 is then injected into the housing 28 enveloping the tube 12 and coil 14 and completely filling the housing 28. A lid 30 is then placed on the housing 28 and can be attached thereto by using mechanical fasteners, glues or welding. The container 10 is filled by connecting the valve 22 to a supply of compressed fluid at a pressure higher than the ambient pressure within the tube 12. Initially if required valve 16 can be opened to bleed any air out of the tube 12, and then closed to allow filling of the tube 12 through valve 22. Once the tube 12 is filled, the valve 22 is closed and disconnected from the supply of compressed fluid. The container 10 can now be easily transported by hand using external handles 32 attached the housing 28. The pressure relief valve incorporated in inlet valve 22 is provided as a safety requirement to ensure that the pressure of the fluid within the container 10 does not exceed a predetermined maximum pressure. In order to use the container 10 valve 16 is connected to a system or device which is to be supplied with the compressed fluid.

It is envisaged that the tube 10 be made from soft drawn seamless aluminum or copper pipe which is wrapped into a helical coil. Aluminum and copper pipe are preferred as they are extensively used, and indeed classified as appropriate for use by the relevant authorities, for high pressure gas/liquid containment. In a test container 10, the tube 12 has a diameter of three eighths of an inch (9.3 mm) and a total length (prior to coiling) of 150 meters. The coil 14 has a height of 20 inches (approximately 500 mm) and a diameter of 10 inches (approximately 250 mm). The container constructed in this manner can hold approximately 10 kilograms of liquid carbon dioxide and has a total weight of 23 kilograms. In comparison, the standard 22 kilogram gas cylinder contains a maximum of 5–7 kilograms of compressed fluid, depending on temperature of the fluid.

Embodiments of the container 10 are particularly, well suited for applications were small volumes of compressed fluid and ease of transport of a container are required. An example of such an application would be to act as a source of refrigerant for a portable refrigeration system of the type described in International Application Number PCT/AU95/00241.

Embodiments of the container 10 allow a greater volume of the compressed fluids such as liquid carbon dioxide to be contained in a smaller and lighter container than currently possible. As liquid is dispensed from the container 10 loss of liquid through boiling is minimised as pressure within the container 10 is maintained at a relatively higher level due to the volume of the pipe 10 in comparison to the operating volume of a conventional compressed gas vessel/bottle. Further, the insulation provided by the foam 20 and the housing 28 ensures that the temperature of the fluid within the tube 12 remains relatively low irrespective of the outside ambient temperature. As previously discussed above, the lower the temperature, the greater the volume of fluid that can be stored. Further, the location of the valve 16 ensures that any liquid form of the fluid is presented to the valve 16. To assist in this the coil 14 is of a handedness to ensure all liquid flows to valve 16 without collecting in the lowest portions of each turn.

Now that an embodiment of the present invention has been described in detail it will be apparent to those skilled in the relevant arts that numerous modifications and variations may be made without departing from the basic inventive concepts. For example, the tube 12 can be made from any material which can bear or otherwise withstand compressed fluids such as stainless steel, indeed even flexible tubes with such physical characteristics may be used. Also, the coil 14 can be one of multiple sets of coils that are nested within each other.

In a further variation, the thermal insulation of the tube 10 can be provided by a sealed evacuated sleeve which is coaxially formed with, and about an outer surface of tile tube 12. In effect, the evacuated sleeve acts as a cryogenic chamber. This can be used either by itself or again in conjunction with the foam 20.

All such applications and variations are deemed to be within the scope of the present invention the nature of which is to be determined from the aforegoing description and the appended claims.

The claims defining the invention are as follows:

1. A container for a compressed fluid, the container including:

a length of tube formed into a coil having a first set of turns and provided at one end with a first valve for controlling flow of the fluid out of the container, wherein said first valve is disposed at a height no greater than that of a lowest of said turns when said turns are disposed about a vertical axis; and heat insulating means enveloping said tube to inhibit exchange of heat between the fluid in said tube and a space immediately surrounding said tube.

2. A container according to claim 1 wherein the coil is in a form of a helix.

3. A container according to claim 1 wherein the container includes a pressure relief valve at an opposite end of the tube and wherein the opposite end is proximate a highest one of the turns.

4. A container according to claim 1 wherein the container includes a pressure relief valve at the opposite end of the tube and wherein the opposite end is proximate a highest one of the turns.

5. A container according to claim 1 wherein the heat insulating means comprises an evacuated sleeve coaxially formed with and about an outer surface of the tube.

6. A container according to claim 1 wherein the container includes one or more straps for binding the turns of the coil together.

7. A container according to claim 1 wherein the container includes one or more straps for binding the turns of the coil together.

8. A portable container for holding a supply of compressed fluid, said container including at least:

a length of tube having first and second opposite ends, said tube formed into a coil in the shape of a helix and having a first set of turns, said first set of turns including a lower most turn near said first end and an upper most turn near said second end;

a first valve coupled with said first end and disposed at a height no greater than that of said lower most turn when said turns are disposed about a vertical axis; and heat insulating means enveloping said first set of turns to inhibit exchange of heat between the fluid in said first set of turns and an immediate surrounding space.

9. A container according to claim 8, wherein the helix includes a second set of turns disposed within the first set of turns.

10. A container according to claim 8, wherein the container includes a pressure relief valve at the opposite end of the tube, and wherein the opposite end is proximate a highest one of the turns.

11. A container according to claim 8, wherein the heat insulating means comprises a setable thermally insulating foam.

12. A container according to claim 8, wherein the heat insulating means comprises an evacuated sleeve coaxially formed with and about an outer surface of the tube.

13. A container according to claim 8, wherein the container includes one or more straps for binding the turns of the coil together.

14. A container for holding a compressed fluid, comprising:

a length of tube formed into a coil having a first set of turns which are disposed about a vertical axis;

a first valve provided at one end of said tube for controlling flow of the fluid out of the container, wherein said first valve is disposed at a height no greater than that of a lowest of said turns when said turns are disposed about a vertical axis; and a heat insulator enveloping said tube to inhibit exchange of heat between the fluid in said tube and a space immediately surrounding said tube.

15. A container according to claim 14, wherein the coil is in a form of a helix.

16. A container according to claim 15, wherein the helix includes a second set of turns disposed within the first set of turns.

17. A container according to claim 14, wherein the container includes a pressure relief valve at the opposite end of the tube, and wherein the opposite end is proximate a highest one of the turns.

18. A container according to claim 14, wherein the container includes one or more straps for binding the turns of the coil together.

19. A container according to claim 14, wherein the heat insulator comprises a setable thermally insulating foam.

20. A container according to claim 14, wherein the heat insulator comprises an evacuated sleeve coaxially formed with and about an outer surface of the tube.

* * * * *